United States Patent [19]

Raccaforte

[11] 4,094,456

[45] June 13, 1978

[54] RECLOSABLE DISPENSING CARTON

[75] Inventor: Harry I. Raccaforte, Western Springs, Ill.

[73] Assignee: Champion International Corporation, Stamford, Conn.

[21] Appl. No.: 790,573

[22] Filed: Apr. 25, 1977

[51] Int. Cl.[2] ..... B65D 5/72

[52] U.S. Cl. ..... 229/17 SC

[58] Field of Search ..... 229/17 SC, 17 R, 39 R

[56] References Cited

U.S. PATENT DOCUMENTS

| | | | |
|---|---|---|---|
| 2,901,097 | 8/1959 | Tamarin | 229/17 SC X |
| 2,902,201 | 9/1959 | Englblom | 229/17 SC |
| 2,983,422 | 5/1961 | Miller, Jr. | 229/17 R |
| 3,040,953 | 6/1962 | Tindall | 229/17 SC |
| 3,190,534 | 6/1965 | Tamarin | 229/17 SC |
| 3,819,093 | 6/1974 | Forbes, Jr. | 229/17 SC X |

FOREIGN PATENT DOCUMENTS

| | | | |
|---|---|---|---|
| 941,524 | 3/1961 | United Kingdom | 229/17 SC |

*Primary Examiner*—Davis T. Moorhead

*Attorney, Agent, or Firm*—Evelyn M. Sommer

[57] ABSTRACT

A dispensing carton, particularly adapted for use with small candies, includes a tubular structure closed at one end, while the upper portion includes a sliding tab which is disposed intermediate overlapping tabs, the latter including registered holes that are covered and uncovered by the sliding tab for dispensing discrete candies, and for re-closing the carton. The sliding tab is hingedly connected to a pivotally connected portion of one end panel of the tubular carton, and cooperating glue portions and glue flaps are embossed/debossed to facilitate manufacture of the carton, and to prevent the glue from interfering with the sliding action of the slidable closure tab. The reclosable dispensing carton is formed from a single sheet of a carton blank.

6 Claims, 5 Drawing Figures

RECLOSABLE DISPENSING CARTON

The subject invention relates to a new and improved reclosable dispensing carton, and a carton blank for forming the dispensing carton. More particularly, the subject invention relates to a carton blank and a dispensing carton wherein one end of the carton includes an overlapping arrangement of tabs, the upper and lowermost tabs having registered openings therein, while an intermediate closure tab is slidably mounted between said overlapping tabs. The slidable closure tab is operative to uncover the registered openings to enable the dispensing of the contents within the carton, after which the closure tab may be slidably moved to a position so as to cover the registered openings for reclosing the carton.

With the foregoing and other features and objectives in view, the subject invention will be described in detail with reference to the accompanying drawing in which.

Figure 1:
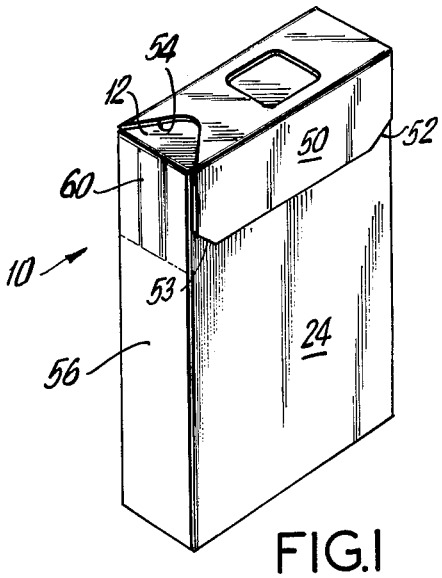
FIG. 1 is a perspective view of the subject dispensing carton in the closed condition.
Figure 2:
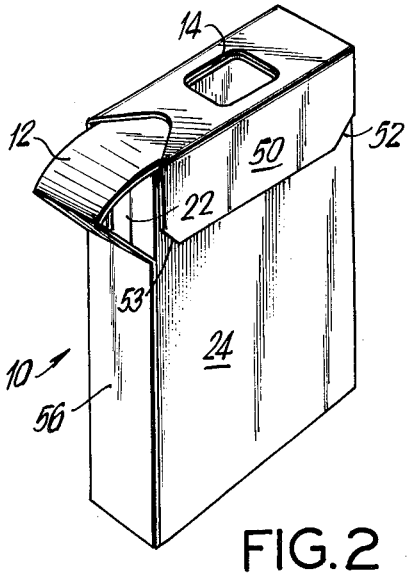
FIG. 2 is another perspective view of the subject dispensing carton with the closure flap being in a position to uncover the registered openings to enable the dispensing of the contents of the carton.
Figure 3:
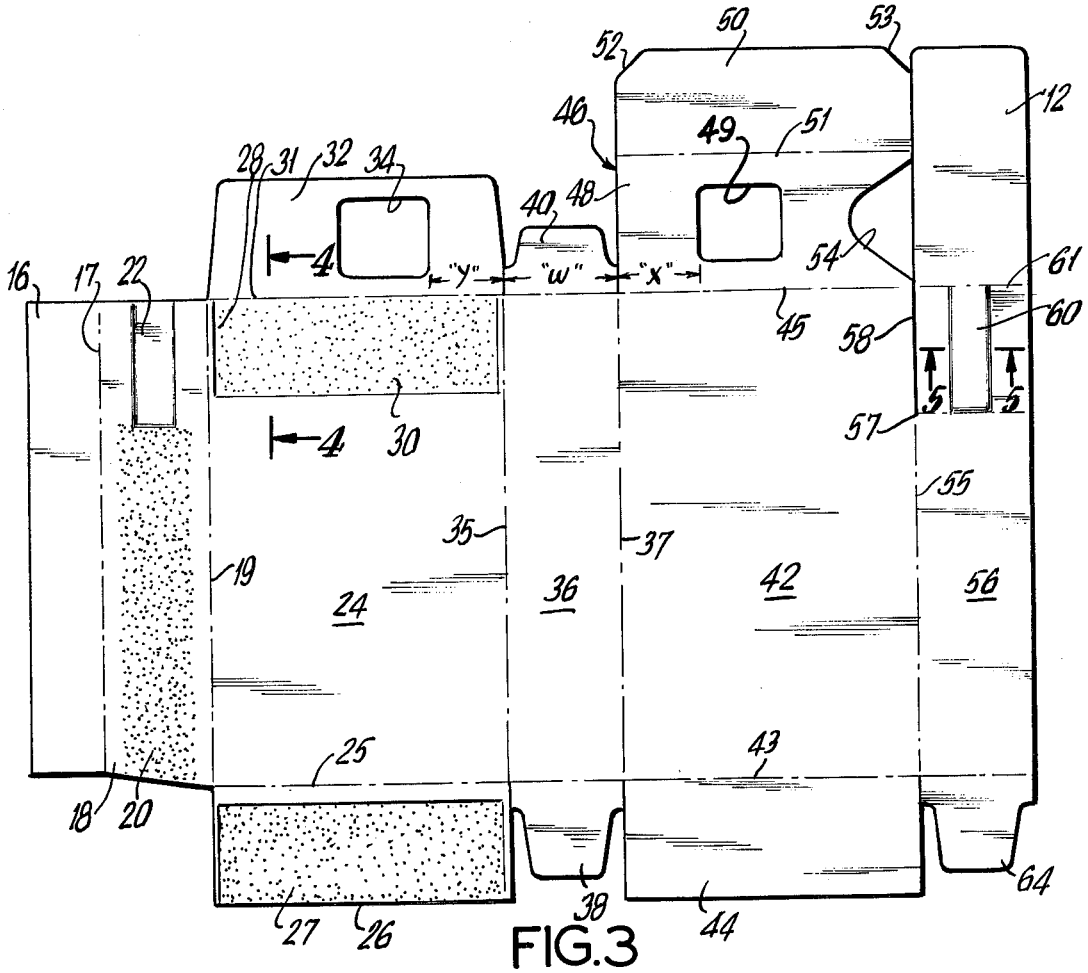
FIG. 3 is a plan view of the subject carton blank.

As illustrated in FIG. 1, the reclosable dispensing carton of the subject invention is of elongated tubular design, having a generally rectangular cross-section, and including a closed bottom, and a top portion that may be partially open for dispensing the contents of the carton, and reclosed for storage purposes. The dispensing carton is generally indicated in FIG. 1 by the numeral 10, and is formed of a single sheet of a carton blank, as shown in FIG. 3. In its fully erected condition, the carton blank is closed at its bottom portion, while the upper portion thereof includes a reclosable opening, with the opening being covered by a slidably mounted closure flap 12 which, when in the extended position shown in FIG. 2, uncovers an opening 14 to enable the contents within the carton to be dispensed. As illustrated in FIG. 1, when the closure flap 12 is moved to its retracted position, the opening 14 is closed.

Figure 4:
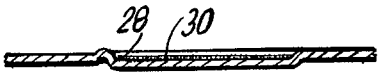
FIG. 4 is a sectional view taken along line 4—4 in FIG. 3.
Figure 5:
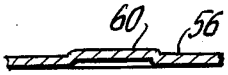
FIG. 5 is a sectional view taken along 5—5 in FIG. 3.

Referring to FIG. 3, the carton blank for forming the carton includes, starting from the left side of FIG. 3, an inner panel 16 that is wholly disposed within the resultant carton 10 when the blank is erected, and which is hingedly connected along line 17 extending from the top to the bottom of the carton to a glue containing end panel 18. Adhesive 20 is applied to the end panel 18 from the bottom thereof to an intermediate point at which an embossed rib 22 extends to the top of the end panel 18. The embossed rib 22 functions to provide structural rigidity to the end panel of the erected carton. In turn, the end panel 18 is hingedly connected along line 19 to a first side panel 24 which is hingedly connected at its bottom along hinge line 25 to a glue tab 26 to which adhesive 27 is applied. Disposed along the entire width of the top portion of the first side panel 24 is a debossed portion or depression 28 having adhesive 30 applied thereto, with the depression more clearly illustrated in FIG. 4. Hingedly connected to the top of the first side panel 24 along hinge line 31 is a tab 32 including a central aperture, designated by the numeral 34. An end panel 36 is hingedly connected along line 35 to the first side panel 24 and includes bottom tab 38 and top tab 40. Hingedly connected to the opposite side of the end panel 36 along hinge 37 is a second side panel 42. A bottom tab 44 is hingedly connected along line 43 to the second side panel 42, while hingedly connected along line 45 to the top of the second side panel 42 is a cover tab, designated by the numeral 46. The cover tab 46 includes a first section 48 having an aperture 49 therein which conforms in size and shape to the aperture 34 of the tab 32. In addition, aperture 49 is cut into the first section 48 so as to be in register with the aperture 34 when the subject dispensing carton is fully erected. A second section of the cover tab 46 is designated by the numeral 50 and is hingedly connected to the first section 48 along hinge line 51. The corners 52, 53 of the second section 50 are chamfered, while a V-shaped groove 54 is cut into the right-most end of the first section 48 as viewed in FIG. 3. The right-most panel of the carton blank is end panel 56 which is hingedly connected to the second side panel 42 along the hinge line 55 that only extends from the bottom of the carton blank to a point designated by the numeral 57 in FIG. 3. From the point 57 to the upper portion of the end panel 56, the second side panel 42 is completely separate from the end panel 56 as indicated by the cut line 58. The end panel 56 includes a debossed rib 60 (see FIG. 5) which also extends laterally of point 57 to the upper portion of the end panel 56. The debossed rib 60 is "embossed" in the carton blank in a direction opposite to the embossing of the embossed rib 22 on the end panel 18. As a result, when the carton 10 is fully erected, the embossed rib 22 and the debossed rib 60 abut one another and thus maintain the upper portions (i.e. above point 57) of the end panel 18 and the end panel 56 away from each other. By this arrangement, the abutting embossed ribs prevent the adhesive 20 from spreading and thus possibly bonding the upper portion of end panel 56 to the upper portion of end panel 18. It is important that the upper portions of these two panels do not adhere at that point or else the closure flap could not readily slide to the open position as shown in FIG. 2.

Hingedly connected to the lower end of the end panel 56 is a tab 64. The width of the tab 40, as designated by the letter "*w*", is equal to or less than the distance between the edge of the first section 48 and the left-most edge of the aperture 49 as designated by the letter "*x*", and also equal to or less than the length designated "*y*" in the tab 32 so that the tab 40, in the erected carton, does not obstruct the registered apertures 34 or 49.

In the erection and assembly of the dispensable carton 10, the several panels of the carton blank are folded about the vertical hinge lines whereby the inner panel 16 is wholly disposed within the resulting tubular carton and the end panel 56 overlaps and is bonded to the end panel 18. The bottom tabs 38 and 64 are folded inwardly, after which the glue tab 26 is folded about hinge line 25 and overlaps said tabs 38 and 64. The closed bottom is then formed by folding of the tab 44 for adhesively bonding tab 44 to the glue tab 26.

In the assembly of the top closure of the elongated tubular carton, tab 40 and apertured tab 32 are folded inwardly, after which closure flap 12 is folded about hinge line 61 to overlie tab 32 and in a position to cover aperture 34. Finally, the cover tab 46 is folded about hinge line 45, and the second section 50 is folded about hinge line 51 pressed into the depression 28 in the first side panel 24 and adhesively bonded thereto.

The cooperation of the second section 50, including its chamfered corners 52 and 53, and the depressed adhesive area 28 aids in providing additional structural rigidity to the dispensing carton. As mentioned above, the cooperation of the embossed rib 22 and the debossed rib 60 aids in ensuring that the upper portions of the respective glue edge 18 and second edge 56 are not adhered by adhesive, or by the printing or varnish materials applied to the carton blank when indicia is applied thereto prior to the erection of the carton.

In the fully erected condition, as shown in FIGS. 1 and 2, the closure flap 12 may be actuated from its wholly retracted position, as shown in FIG. 1, wherein the carton is sealed to the extended position shown in FIG. 2. At that time, the opening 14, defined by the registered apertures 34 and 49, is open to enable the dispensing of the contents from the dispensing carton 10. As shown in FIG. 2, in the extended position, the closure flap pivots about the hinge line 61 and a hinge line extending laterally across from the point 57, and corresponding to the lower portion of the debossed rib 60. The latter also functions to provide structural rigidity to the upper portion of the second edge, and this is especially important to ensure the structural integrity of the closure flap 12 as it is cycled between its extended and retracted positions.

This invention is not limited to the particular details of construction and embodiments illustrated and described hereinabove, as many equivalents will suggest themselves to those skilled in the art. It is accordingly desired that the appended claims be given a broad interpretation commensurate with the scope of the invention within the art.

What is claimed is:

1. A reclosable dispensing carton made of a single sheet of carton blank and comprising an elongated tubular enclosure including first and second side panels, and first and second end panels; said enclosure being closed at one end while the other end is closed by, in turn and in overlapping relationship, a first tab extending from said first side panel and including an aperture therein, said aperture disposed intermediate the length of said first tab; a second tab extending from said first end panel and extending for only a portion of the length of said first tab so as to not obstruct said aperture; an elongated closure tab extending from said second end panel and covering the aperture; and a cover tab extending from said second side panel and including a first section overlapping said closure tab and an aperture which is in registration with the aperture of said first tab and a second section that is adhesively bonded to said first side panel; said closure tab being connected to a portion of said second end panel that is pivotally connected to said tubular enclosure whereby said closure tab is slidably received intermediate the first tab and said first section of the cover tab, and may be slidably displaced in a direction opposite to said second tab extending from said first end panel to uncover the registered apertures in the first tab and the cover tab, said first side panel including a depressed glue area receiving wholly therein said second section of said cover tab.

2. A reclosable dispensing carton as in claim 1 wherein said first section of said cover tab includes a V-shaped groove disposed adjacent said second end panel.

3. A reclosable dispensing carton as in claim 1 wherein said pivotal portion of said second end panel is reenforced by a rib structure embossed in the carton blank, and a second embossed rib is provided on a third end panel connected to said first side panel, said embossed ribs being in abutting relationship to maintain said second and third end panels in spaced relationship along said ribs, and the remainder of said second and third end panels being adhesively connected.

4. A reclosable dispensing carton as in claim 1 wherein the portion of said first side panel to which the second section is bonded is embossed in the carton blank.

5. A reclosable dispensing carton as in claim 1 wherein said second section of the cover tab includes chamfered corners received within said depressed area.

6. A carton blank for a reclosable dispensing carton having a slidable mounted valve opening at the top thereof, and a closed bottom, said blank comprising, in turn, an inner panel to be disposed within the erected carton;

a first end panel having glue extending from the bottom portion thereof to a point intermediate the length thereof, said first end panel including an embossed rib extending from said point to the top portion of said first end panel;

a first side panel having a glue tab extending from the bottom thereof, and an elongated tab extending from the top thereof, said elongated tab having an aperture intermediate the length thereof, said first side panel having an embossed glue portion depressed therein adjacent the top portion thereof;

a second end panel having tabs respectively extending from the top and bottom portions thereof;

a second side panel having a tab extending from the bottom portion thereof, and a cover tab extending from the top portion thereof, said cover tab including a first section hingedly connected to said second side panel and including a central aperture therein, and a second section hingedly connected to said first section and adapted to be engaged within the embossed glue portion of said first side panel; and a third end panel including a tab at the lower portion thereof, and a closure flap hingedly connected to the upper portion thereof, said third end panel being hingedly connected to said second side panel from the bottom portion thereof to a point intermediate the contiguous edges of said second side and said third end panel.

* * * * *